US005477804A

United States Patent [19]

Chan

[11] Patent Number: 5,477,804

[45] Date of Patent: Dec. 26, 1995

[54] FOLDING COLLAPSIBLE POWER BOAT

[76] Inventor: Jhu-Yuon Chan, No. 5, Lane 49, Ta Nan Rd., Nan Tou Hsien, Taiwan

[21] Appl. No.: 390,867

[22] Filed: Feb. 17, 1995

[51] Int. Cl.[6] ..... B63B 7/00

[52] U.S. Cl. ..... 114/354; 114/123

[58] Field of Search ..... 114/123, 61, 352–354, 114/68, 360; 224/42.01, 42.03 R; 441/35

[56] References Cited

U.S. PATENT DOCUMENTS 3,126,558 3/1964 Nolan et al. ..... 114/352
5,353,733 10/1994 Evans ..... 114/353

*Primary Examiner*—Edwin L. Swinehart
*Attorney, Agent, or Firm*—Bacon & Thomas

[57] ABSTRACT

A folding collapsible power boat including a hull consisting of a forward hull section and an aft hull section longitudinally hinged together, two pairs of floats respectively bilaterally hinged to the forward hull section and the aft hull section and moved between the non-operative position, in which the floats are received inside the forward and aft hull sections, and the operative position, in which the floats are closely attached to two opposite sides of the forward and aft hull sections, and a stretcher unit having a cross bar inserted through a transverse groove between the forward and aft hull sections and two parallel tie rods joined by the cross bar and bridged over the floats to hold them in the operative position.

4 Claims, 6 Drawing Sheets

FOLDING COLLAPSIBLE POWER BOAT

BACKGROUND OF THE INVENTION

The present invention relates to power boats, and relates more particularly to a folding collapsible power boat that can be collapsed to reduce its storage space when it is not in use.

A power boat is generally comprised of a streamlined hull and an outboard engine fastened to the stern of the hull. As the hull is not collapsible, it is difficult to store or deliver the power boat. Furthermore, because the hull is streamlined, the water area of the power boat is limited, and the power boat tends to capsize when it is suddenly turned to another direction.

SUMMARY OF THE INVENTION

The present invention has been accomplished to provide a folding collapsible power boat which eliminates the aforesaid drawbacks. It is one object of the present invention to provide a power boat which is collapsible. It is another object of the present invention to provide a folding collapsible power boat which can be quickly assembled and conveniently collapsed. It is still another object of the present invention to provide a folding collapsible power boat which has a broad water area for a safety sailing.

According to one aspect of the present invention, the folding collapsible power boat comprises a hull consisting of a forward hull section and an aft hull section longitudinally hinged together, two pairs of floats respectively bilaterally hinged to the forward hull section and the aft hull section and moved between the non-operative position, in which the floats are received inside the forward and aft hull sections, and the operative position, in which the floats are closely attached to two opposite side ports of the forward and aft hull sections, and a stretcher unit having a cross bar inserted through a transverse groove between the forward and aft hull sections and two parallel tie rods joined by the cross bar and bridged over the floats to hold them in the operative position.

According to another aspect of the present invention, the cross bar and the tie rods are respectively made of hollow structure and stuffed with foamed material, and therefore they are floatable.

DETAILED DESCRIPTION OF THE PREFERRED EMBODIMENT

Figure 1:
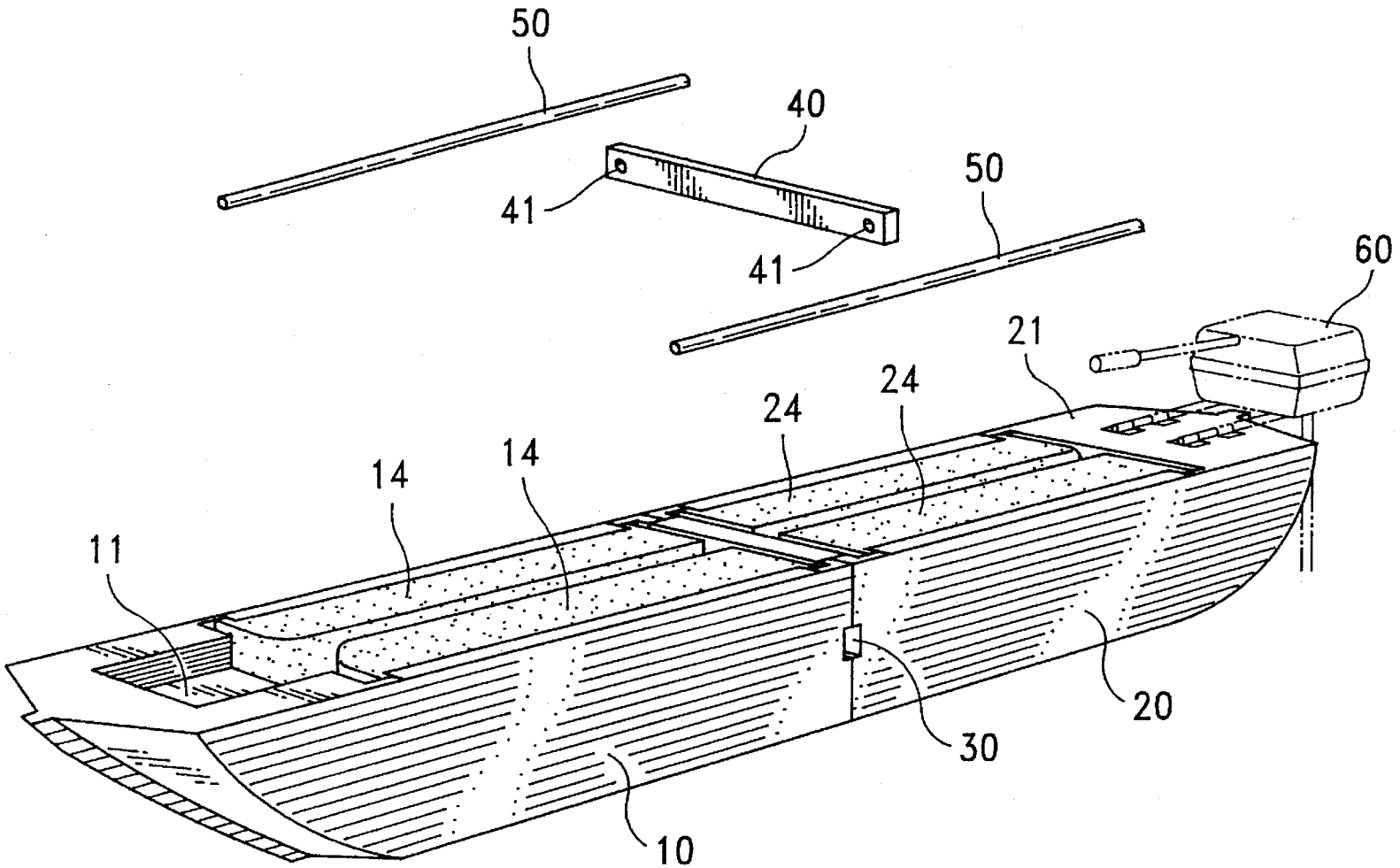
FIG. 1 shows a folding collapsible power boat according to the present invention.
Figure 2A:
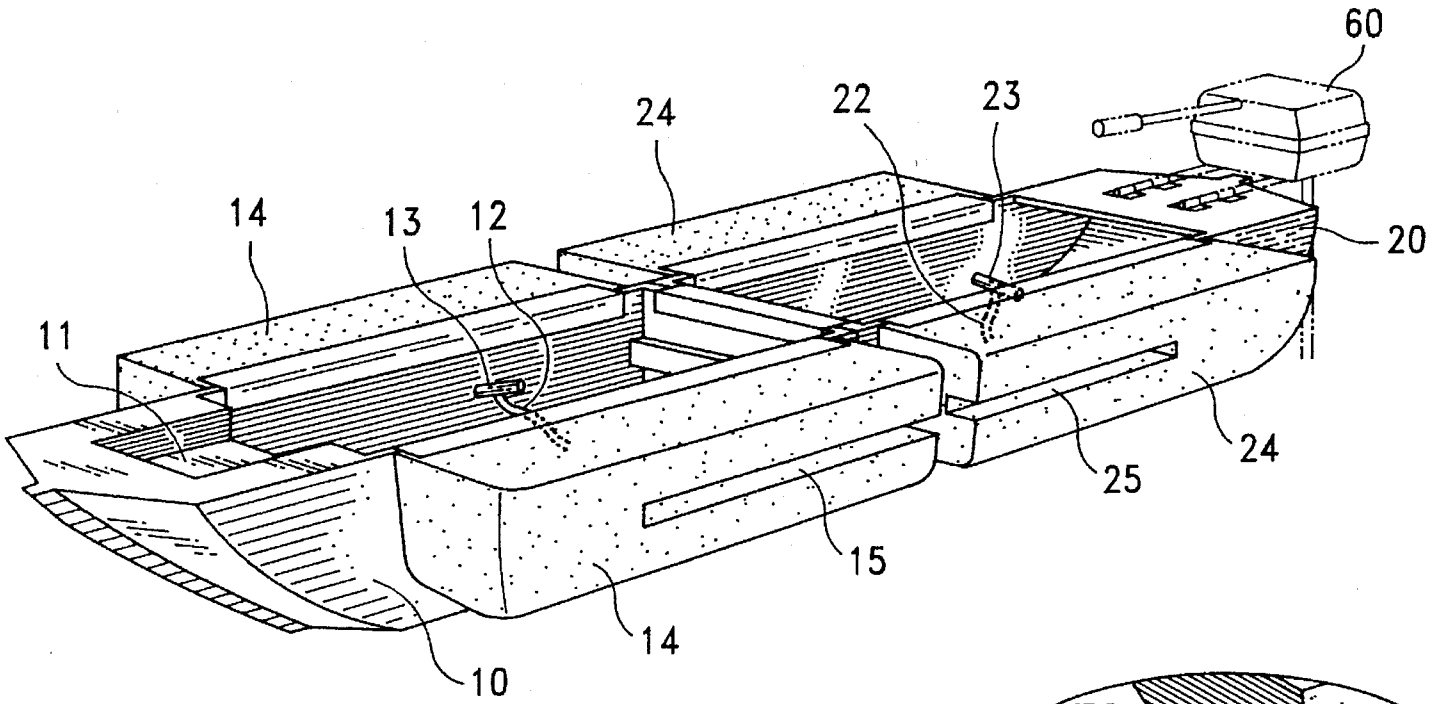
FIG. 2A shows the floats are turned outside the hull sections and set in the operative position.
Figure 2B:
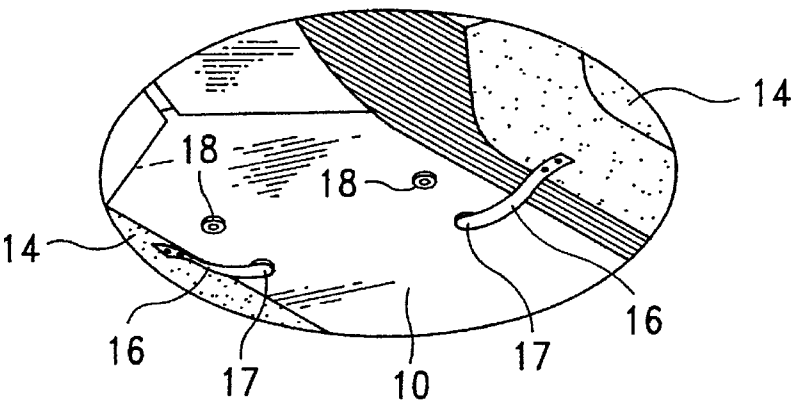
FIG. 2B is a bottom view in an enlarged scale of the front part of FIG. 2A, showing the relative positions of the fastening belts on the floats and the fastening elements on the bottom side of the forward hull section.
Figure 3A:
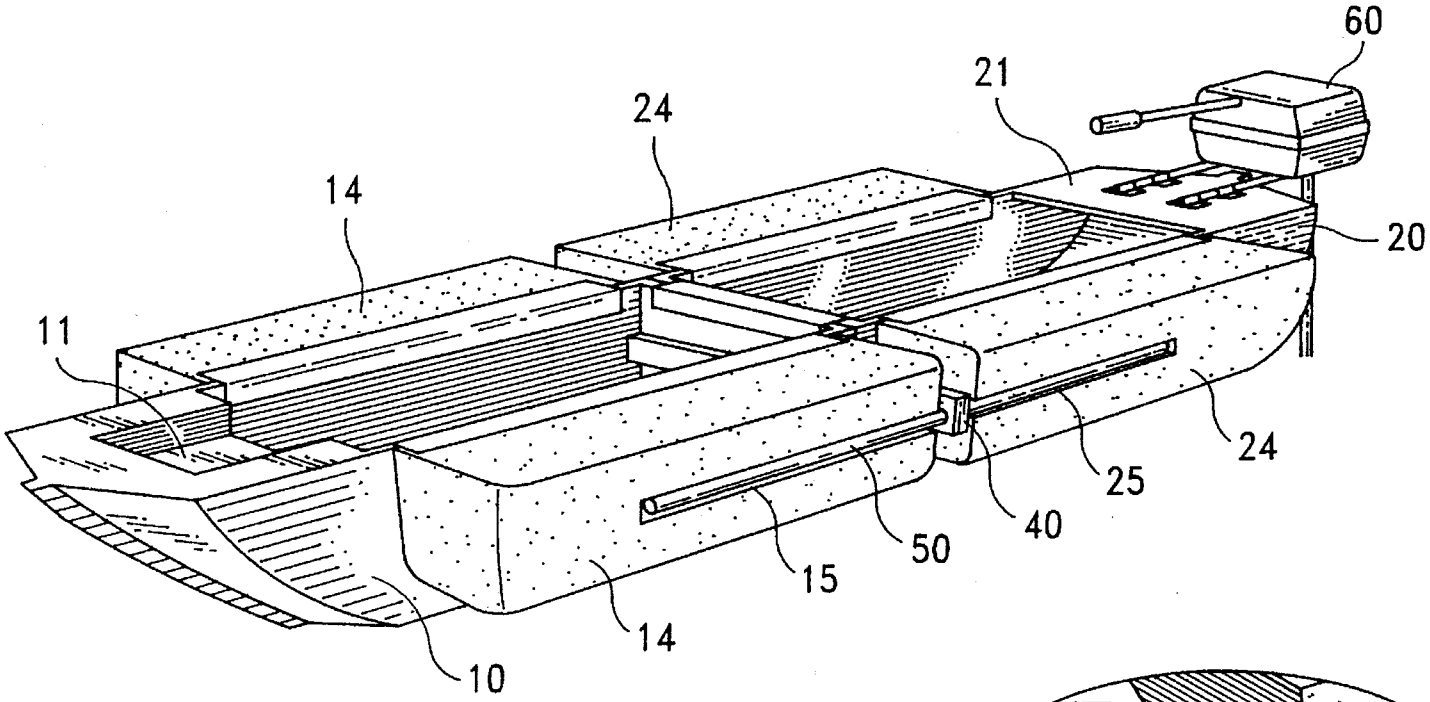
FIG. 3A is similar to FIG. 2A but showing the stretcher unit installed.
Figure 3B:
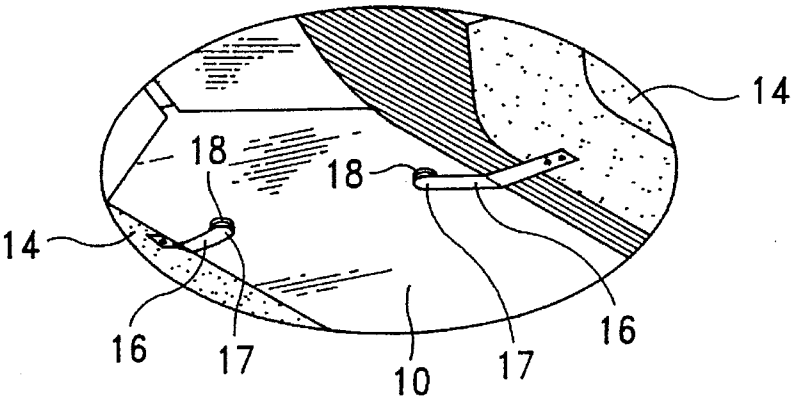
FIG. 3B is similar to FIG. 2B but showing the fastening belts fastened to the fastening elements on the forward hull section.
Figure 5:
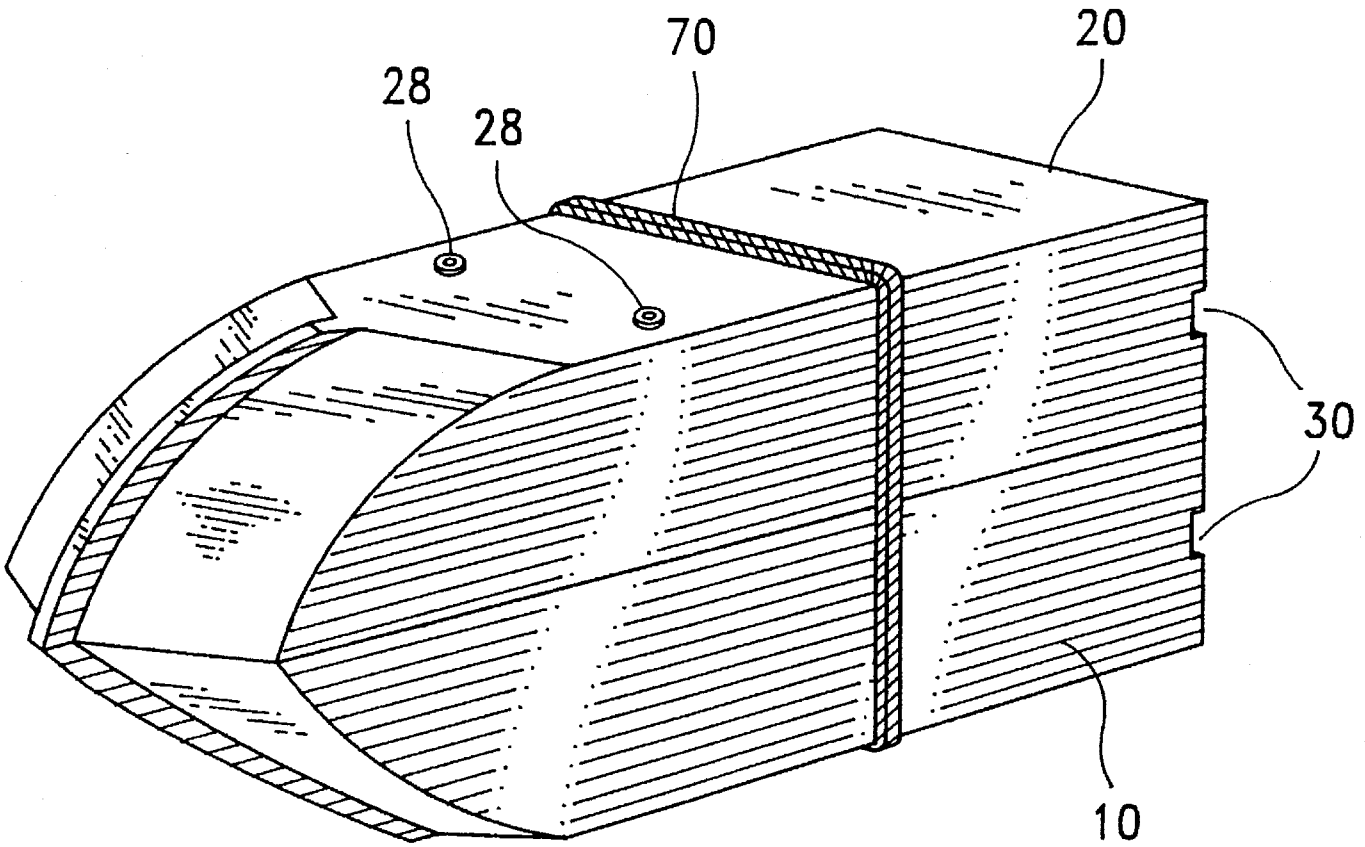
FIG. 5 shows the power boat collapsed and tied up by a rope.

Referring to FIGS. 1 and 2, the hull of a power boat in accordance with the present invention consists of a forward hull section 10 and an aft hull section 20 hinged together. The forward hull section 10 has a seat 11 at the bow. The stern 21 of the aft hull section 20 is equipped with an outboard engine 60. Each hull section 10 or 20 further comprises a retainer rod 13 or 23 secured in place by a respective rope 12 or 22. When the hull sections 10 and 20 are extended out and longitudinally aligned, a transverse slot 30 is formed on the abutted area between the hull sections 10 and 20. Two pairs of floats 14 and 24 are respectively bilaterally hinged to the hull sections 10 and 20 such that the floats 14 and 24 can be received inside the hull sections 10 and 20 as shown in FIG. 1, or turned to the outside and attached to the opposite sides of the hull sections 10 and 20 as shown in FIG. 2A. The floats 14 and 24 have a respective longitudinal groove 15 or 25 at an outer side, and a fastening belt 16 or 26 (26 is not shown) with a fastening element 17 or 27 (27 is not shown) for connection to a respective fastening element 18 or 28 (see also FIG. 5) on the bottom side of the hull section 10 or 20 (see FIG. 2B). When the floats 14 and 24 are turned outside the hull sections 10 and 20, the fastening elements 17 and 27 are respectively fastened to the fastening elements 18 and 28 (see 3B), then a cross bar 40 is inserted into the transverse slot 30, and then two tie rods 50 are respectively inserted through two opposite axle holes 41 at two opposite ends of the cross bar 40 and respectively fitted into the longitudinal grooves 15 and 25 on the floats 14 and 24 at two opposite sides of the hull sections 10 and 20, and therefore the floats 14 and 24 are secured in position (see 3A). The aforesaid cross bar 40 and tie rods 50 for a stretcher unit to hold the hull sections 10 and 20 and the floats 14 and 24 in the operative condition. When the folding collapsible power boat is assembled, the outside engine 60 is installed in the stern 21 of the aft hull section 20. The installation of the floats 14 and 24 greatly increases the water area and buoyancy of the power boat, and therefore the sailing of the power boat is stable and safe.

Figure 4:
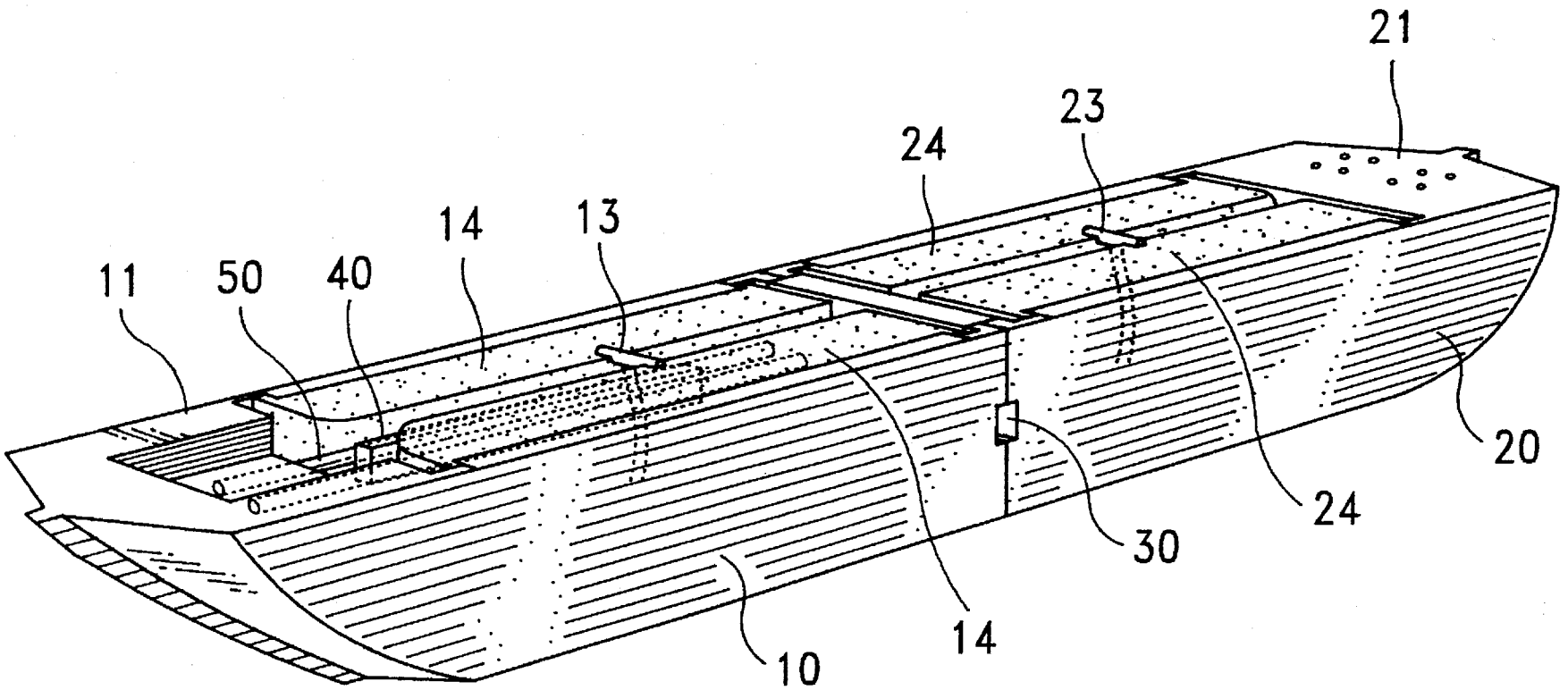
FIG. 4 shows the floats received in the hull and held down by the retainer rods.

When the power boat is not used, it can be collapsed by performing the aforesaid procedure in the reversed way. The outboard engine 60 is removed from the stern 21 of the aft hull section 20, then the tie rods 50 are removed from the cross bar 40 and then the cross bar 40 is removed from the hull sections 10 and 20, and then the floats 14 and 24 are turned from the outside to the inside and held down by the retainer rods 13 and 23 by bridging the retainer rods 13 and 23 over the floats 14 and 24 respectively (see FIG. 4), and then the cross bar 40 and the tie rods 50 are gathered together and received in the forward hull section 10 or the aft hull section 20, and then the forward hull section 10 and the aft hull section 20 are folded up, causing the floats 14 and 24 abutted, and then the collapsed power boat is tied up by a rope 70 (see FIG. 5).

Figure 6:
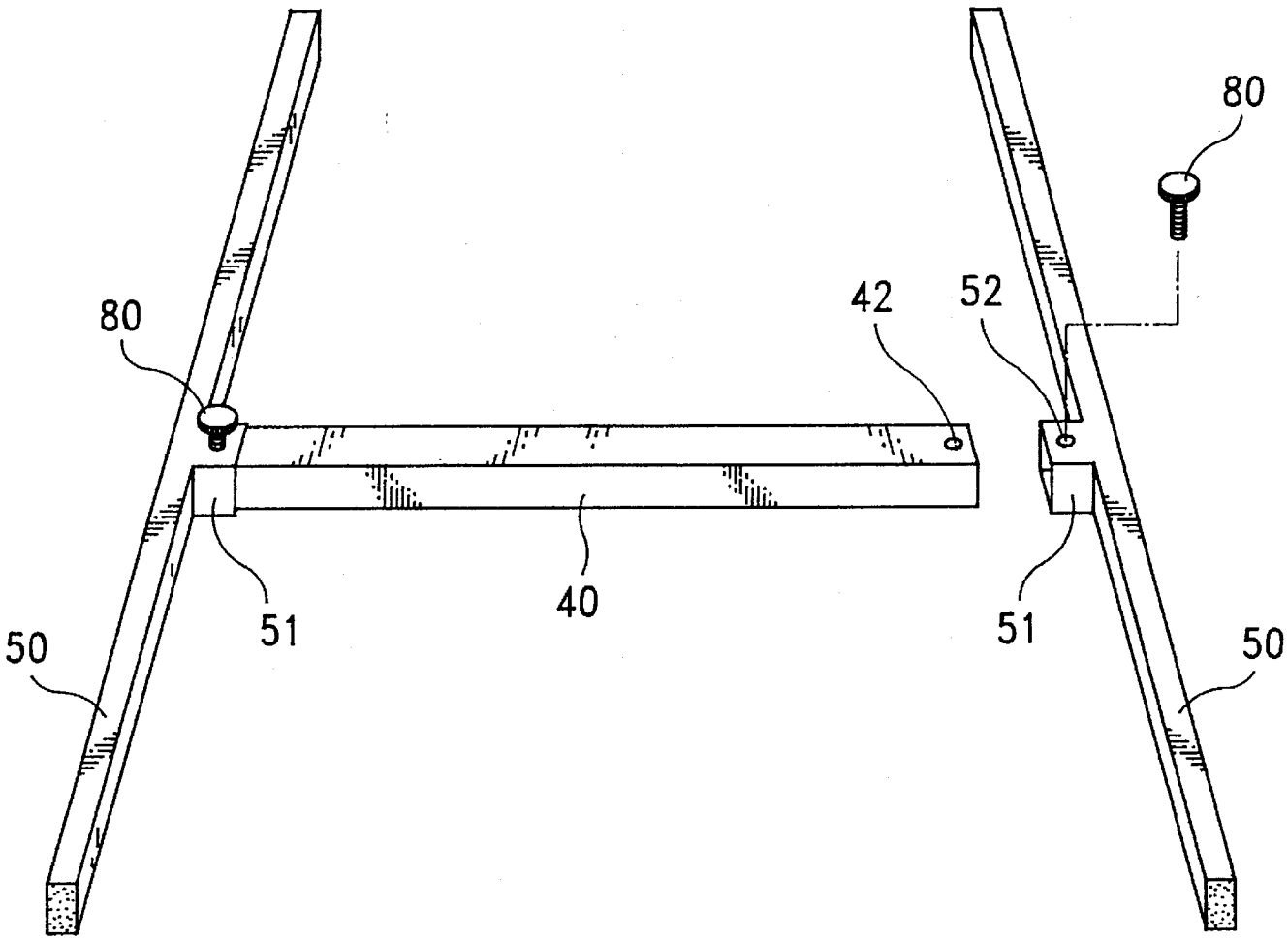
FIG. 6 shows an alternate form of the stretcher unit according to the present invention.

FIG. 6 shows an alternate form of the stretcher unit 40 and 50. According to this alternate form, the cross bar 40 and the tie rods 50 are respectively made in a hollow configuration and stuffed with foamed material and then watertightly sealed. Therefore, this structure of stretcher unit is floatable. Furthermore, the cross bar has a screw hole 42 at each end; each tie rod 50 has a receptacle 51 with a screw hole 52 in the middle. When the two opposite ends of the cross bar 40 are respectively inserted into the receptacles 51 of the tie rods 50, screws 80 are respectively threaded into the screw holes 52 and 42 to securely fixed the tie rods 50 and the cross bar 40 together.

What is claimed is:

1. A folding collapsible power boat comprising:

a hull consisting of a forward hull section and an aft hull section hinged together, said forward hull section having a flat rear side and a transverse groove on the flat rear side, said aft hull section having a flat front side hinged to the flat rear side of said forward hull section and a transverse groove on the flat front side, said forward and aft hull sections each having a plurality of fastening elements at a respective bottom side;

two pairs of floats respectively bilaterally hinged to said forward hull section and said aft hull section and moved between a non-operative position, in which said floats are received inside said hull, and an operative position, in which the floats are closely attached to two opposite sides of said hull, said floats having a respective longitudinal groove at an outer side and a plurality of fastening belts at a bottom side, said fastening belts each having a fastening element for connection to the fastening elements on said forward and aft hull sections respectively when said floats are moved to said operative position;

a stretcher unit fastened to the transverse grooves on said forward and aft hull sections to hold down said floats in said operative position, said stretcher unit comprising a cross bar and two parallel tie rods joined by said cross bar, said cross bar being inserted into the transverse grooves on said forward and aft hull sections, said tie rods being respectively fitted into the longitudinal grooves on said floats; and holding-down means for holding said floats in said non-operative position.

2. The folding collapsible power boat of claim 1 wherein said holding-down means comprises two retainer rods respectively fastened to said forward and aft hull sections for bridging over said floats when said floats are received inside said hull.

3. The folding collapsible power boat of claim 1 wherein said cross bar has two axle holes at two opposite ends thereof through which said tie rods are respectively inserted.

4. The folding collapsible power boat of claim 1 wherein said tie rods are respectively made of hollow structure and shuffed with foamed material, each having a receptacle and a screw hole through said receptacle; said cross bar is made of hollow structure and stuffed with foamed material, having two opposite ends respectively fitted into the recetacles of said tie rods and two screw holes on the two opposite ends respectively fixed to the screw holes on the receptacles of said tie rods by screws.

* * * * *